US012269667B2

(12) United States Patent
Mammoser et al.

(10) Patent No.: US 12,269,667 B2
(45) Date of Patent: Apr. 8, 2025

(54) BEVERAGE CONTAINER WITH INSERT

(71) Applicant: Frost Buddy LLC, Newton, IL (US)

(72) Inventors: Mitch Mammoser, Newton, IL (US); Brock Mammoser, Newton, IL (US)

(73) Assignee: Frost Buddy LLC, Newton, IL (US)

( * ) Notice: Subject to any disclaimer, the term of this patent is extended or adjusted under 35 U.S.C. 154(b) by 8 days.

(21) Appl. No.: 18/154,955

(22) Filed: Jan. 16, 2023

(65) Prior Publication Data

US 2024/0239590 A1 Jul. 18, 2024

(51) Int. Cl.
*B65D 81/38* (2006.01)
*B65D 25/02* (2006.01)
*B65D 43/02* (2006.01)

(52) U.S. Cl.
CPC ..... *B65D 81/3881* (2013.01); *B65D 25/02* (2013.01); *B65D 43/0231* (2013.01)

(58) Field of Classification Search
CPC ..... A47G 23/02; A47G 19/22; B65D 81/38
USPC ..... 220/592.16, 739
See application file for complete search history.

(56) References Cited

U.S. PATENT DOCUMENTS

| | | | | |
|---|---|---|---|---|
| 482,603 | A | 9/1892 | Weigel | |
| 2,266,494 | A | 12/1941 | Adams | |
| D157,536 | S | 2/1950 | Richardson | |
| 2,727,645 | A | 12/1955 | Dore | |
| D228,721 | S | 10/1973 | Todd | |
| D245,384 | S | 8/1977 | Ashton | |
| D293,642 | S | 1/1988 | Rubbright, III et al. | |
| D303,199 | S | 9/1989 | Parsons | |
| D332,891 | S | 2/1993 | Cumberland | |
| D368,410 | S | 4/1996 | Shiner | |
| D370,629 | S | 6/1996 | Lynch | |
| D400,763 | S | 11/1998 | Taylor et al. | |
| D422,452 | S | 4/2000 | Persson | |
| 6,419,108 | B1 | 7/2002 | Toida et al. | |
| D466,755 | S | 12/2002 | Henry | |
| D513,939 | S | 1/2006 | Leonzo | |
| 7,118,005 | B2 * | 10/2006 | Shimazaki | F25D 3/08 220/737 |
| 7,328,876 | B2 * | 2/2008 | Jones | B60N 3/107 220/694.1 |

(Continued)

FOREIGN PATENT DOCUMENTS

| | | |
|---|---|---|
| CA | 62880 | 4/1989 |
| CN | 113273869 A | 8/2021 |

(Continued)

OTHER PUBLICATIONS

International Search Report and Written Opinion in PCT/US2021/059613, mailed Mar. 30, 2022, 13 pages.

(Continued)

*Primary Examiner* — J. Gregory Pickett
*Assistant Examiner* — Niki M Eloshway
(74) *Attorney, Agent, or Firm* — Lewis Rice LLC

(57) ABSTRACT

A multi-purpose insulating beverage container includes a container body with an open upper end, a removable insert configured for insertion into the container body via the open upper end, and a cover adapted to engage the container body and retain the insert within the container body. The interior of the container body and insert include a plurality of annular ledges with different diameters sized to support beverage bottles or cans of different sizes.

12 Claims, 15 Drawing Sheets

(56) References Cited

U.S. PATENT DOCUMENTS

| | | | | |
|---|---|---|---|---|
| D597,679 | S | 8/2009 | Shigesada et al. | |
| D598,122 | S | 8/2009 | Shigesada et al. | |
| D622,108 | S | 8/2010 | McKinght | |
| D622,553 | S | 8/2010 | Bollenbacher | |
| D644,064 | S | 8/2011 | DuBois | |
| D661,544 | S | 6/2012 | Enghard | |
| D675,066 | S | 1/2013 | Conlin et al. | |
| 8,544,678 | B1 | 10/2013 | Hughes | |
| D704,383 | S | 5/2014 | Edlin | |
| D761,618 | S | 7/2016 | Lapsker | |
| D777,529 | S | 1/2017 | Kellow, Jr. | |
| D798,673 | S | 10/2017 | Gilmore | |
| D799,939 | S | 10/2017 | Lowitz | |
| D807,712 | S | 1/2018 | Miller et al. | |
| D808,733 | S * | 1/2018 | Spivey | D7/624.2 |
| D823,070 | S | 7/2018 | Boroski | |
| D823,647 | S | 7/2018 | Curl, Jr. | |
| D824,732 | S | 8/2018 | Hsiao et al. | |
| D836,403 | S | 12/2018 | Spivey et al. | |
| D836,404 | S | 12/2018 | Spivey et al. | |
| D875,478 | S | 2/2020 | Bingham | |
| D883,042 | S | 5/2020 | Blickman et al. | |
| 10,717,587 | B2 | 7/2020 | Tarbutton | |
| D897,151 | S | 9/2020 | Bullock et al. | |
| 10,773,873 | B2 | 9/2020 | Callinan et al. | |
| D906,111 | S | 12/2020 | Griffin et al. | |
| D922,832 | S | 6/2021 | Vickroy | |
| D927,934 | S | 8/2021 | Jianyi et al. | |
| D946,400 | S | 3/2022 | Marantis et al. | |
| D953,816 | S | 6/2022 | Lin et al. | |
| 11,414,258 | B2 | 8/2022 | Jacob | |
| D977,973 | S | 2/2023 | Kutcher | |
| D992,361 | S | 7/2023 | Muspratt-Williams et al. | |
| D1,001,719 | S | 10/2023 | Lovasz | |
| 11,819,149 | B1 * | 11/2023 | Etchison | B65D 25/28 |
| D1,037,789 | S | 8/2024 | Lee | |
| D1,045,529 | S | 10/2024 | Lee | |
| D1,046,562 | S | 10/2024 | Korovilas et al. | |
| D1,046,619 | S | 10/2024 | Bullock et al. | |
| 2009/0071969 | A1 | 3/2009 | Lopez | |
| 2018/0242765 | A1 | 8/2018 | Rane et al. | |
| 2019/0274457 | A1 | 9/2019 | Robertson | |
| 2021/0139226 | A1 * | 5/2021 | Monaghan | B65D 81/3881 |
| 2022/0177217 | A1 * | 6/2022 | Gu | B65D 81/3881 |
| 2023/0380617 | A1 * | 11/2023 | Mobley | A47G 23/02 |
| 2023/0389739 | A1 * | 12/2023 | Mobley | A47G 23/0241 |

FOREIGN PATENT DOCUMENTS

| | | | | |
|---|---|---|---|---|
| CN | 307256929 | | 4/2022 | |
| EP | 3662797 | A2 | 6/2020 | |
| GB | 1036134 | | 4/1987 | |
| GB | 1043466 | | 12/1987 | |
| GB | 2596657 | A * | 1/2022 | A47G 23/02 |
| HK | 2219457-0008 | | 6/2022 | |
| JP | 2019043640 | A | 3/2019 | |
| KR | 301116980.0000 | | 7/2021 | |

OTHER PUBLICATIONS 16 oz Can Adapter for The Yeti Colster—Perfect for 16 oz. Cans of Craft Beer! Patented! Adapter Only, 4More, 2017 [retrieved on Mar. 25, 2024]. Retrieved from the Internet: <URL:https://www.amazon.com/4More-Adapter-Colster-Perfect-Patented/dp/B072R5674S>, 6 pages.

5 Way Drink Chiller—Set of 2, BUILT, [retrieved on Mar. 25, 2024]. Retrieved from the Internet: <URL:https://www.builtny.com/products/5-way-drink-chiller-2-pack?>, 4 pages.

Arctic Adapter, Brumate, 2024, [retrieved on Mar. 25, 2024]. Retrieved from the Internet: <URL:https://www.brumate.com/products/arctic-adapter-by-brumate-black?>, 4 pages.

Bottle Adapter for Yeti to Cirkul | BPA Free Plastic, Food Grade Silicone | Fits 12, 18, 26, 36, 46, 64 oz Yeti Rambler Bottles, Jmoe, 2023 [retrieved on Mar. 25, 2024]. Retrieved from the Internet: <URL: https://www.amazon.com/Jmoe-USA-Adapter-Plastic-Silicone/dp/B0CR71S9NP>, 8 pages.

Buy Makita 451533-2 Chuck Cover, LXRH01, Repair Tool Parts, 2024 [retrieved on Mar. 25, 2024]. Retrieved from the Internet: <URL:https://www.repairtoolparts.com/makita-parts/miscellaneous-parts/makita-451533-2-chuck-cover-Ixrh01>, 3 pages.

Can Cooler—4-in-1 Stainless Steel Can Holder and Beer Bottle Holder, for 12 oz and 16 oz Slim and Regular Cans, Bottles and Mixed Drinks, Freezer Mug for Beverage, Beer and Coffee (Stainless steel), Gilozny, 2023 [retrieved on Mar. 25, 2024]. Retrieved from the Internet: <URL: https://www.amazon.com/Can-Cooler-4-1-Stainless/dp/B0BW3PV7P1>, 8 pages.

Can Cooler Adapter Inserts, TEMPERCRAFT, 2024 [retrieved on Mar. 25, 2024]. Retrieved from the Internet: <URL: https://www.tempercraft.com/products/can-cooler-adapter-inserts>, 2 pages.

Freeze (2 Pack)—A Multi-Use Freezable Ice Pack 12oz Can Adapter for 16oz Tall Can Tumblers Also use w/Lunch Boxes, Diaper Bags, Sore Muscles, Compatible with YETI MiiR CamelBak BruMate (Blue), FITY, 2023 [retrieved on Mar. 25, 2024]. Retrieved from the Internet: <URL: https://www.amazon.com/FITY-FREEZE-Pack-Freezable-Compatible/dp/B0C3J5TV38>, 9 pages.

Frost Buddy Can Insert, Printables, 2024 [retrieved on Mar. 25, 2024]. Retrieved from the Internet: <URL:https://www.printables.com/model/469003-frost-buddy-can-insert>, 4 pages.

IBC Connector, GrabCAD, 2021 [retrieved on Mar. 25, 2024]. Retrieved from the Internet: <URL:https://grabcad.com/library/ibc-connector-1>, 2 pages.

Plug-N-Play Cap, Hydra Pak, 2024, [retrieved on Mar. 25, 2024]. Retrieved from the Internet: <URL:https://www.rei.com/product/190153/hydrapak-plug-n-play-cap?>, 9 pages.

Universal XL Insert, Frost Buddy, 2024 [retrieved on Mar. 25, 2024]. Retrieved from the Internet: <URL:https://frostbuddy.com/products/big-buddy-insert-black>, 1 page.

YETI/RTIC/MiIR Colster/Cooler/Chiller ADAPTO Ring 16oz -> 12Oz Adapter *Normal 12Oz and 12Oz Skinny Cans*—Dual Purpose, Vertigo Makes, 2024 [retrieved on Mar. 25, 2024]. Retrieved from the Internet: <URL:https://www.etsy.com/listing/1251107632/yetirticmiir-colstercoolerchiller-adapto?>, 1 page.

* cited by examiner

BEVERAGE CONTAINER WITH INSERT

FIELD OF THE INVENTION

A multi-purpose insulating beverage container includes a container body with an open upper end, a removable insert configured for insertion into the container body via the open upper end, and a cover adapted to engage the container body and retain the insert within the container body. The interior of the container body and insert include a plurality of annular ledges with different diameters sized to support beverage bottles or cans of different sizes.

BACKGROUND OF THE INVENTION

Insulating beverage containers are widely used to provide thermal insulation for beverage cans or bottles. Typical known insulating beverage containers partially enclose the beverage can or bottle while leaving the top portion of the can or bottle exposed, allowing the user to drink from the exposed open top of the can or bottle. Such beverage containers are typically sized to accommodate a standard 12 oz. beverage can or a standard 12 oz. beverage bottle. However, beverages are also provided in smaller diameter slim cans or in larger diameter 16 oz. beverage cans, 16 oz. beverage bottles, 16.9 oz. beverage bottles, 20 oz. beverage bottles. A need exists for a single, multi-purpose, insulating beverage container capable of partially enclosing and insulating beverage cans or bottles of a variety of diameters and heights.

SUMMARY

It is the object of the present invention to provide a multi-purpose insulating beverage container capable of accommodating beverage cans or bottles of a variety of diameters and heights. The insulating beverage container is further capable of serving as a container for beverages itself. In some embodiments, the present invention is an insulating beverage container comprising a container body having an interior bottom, an inner wall extending peripherally around the interior bottom and terminating in an open upper end, an exterior bottom spaced from the interior bottom, and an outer wall extending peripherally around the exterior bottom and spaced from the inner wall to define an insulating space between the inner wall and outer wall and terminating at the open upper end, wherein the inner wall includes an upper portion and a lower portion, wherein the lower portion of the inner wall has a smaller diameter than the upper portion of the inner wall, and wherein the inner wall includes an annular inner wall ledge formed between the upper portion of the inner wall and lower portion of the inner wall; a cover removably attached to the open upper end; and an insert removably nested within the container body through the open upper end, the insert having a circular open first end, a circular open second end, a side extending between the first end and the second end, and an internal bore extending between the first end and the second end, wherein the internal bore has a plurality of different interior diameters, wherein the side of the insert includes a first portion adjacent the first end and a second portion adjacent the second end, wherein the first portion of the side has a smaller diameter than the second portion of the side, and wherein the side includes an annular side ledge formed between the first portion of the side and the second portion of the side.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein is not necessarily intended to address every object described herein, and each embodiment does not necessarily include each feature described. Other forms, embodiments, objects, advantages, benefits, features, and aspects of the present invention will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

A better understanding of the present invention will be had upon reference to the following description in conjunction with the accompanying drawings.

DETAILED DESCRIPTION OF THE PREFERRED EMBODIMENTS

Figure 1A:
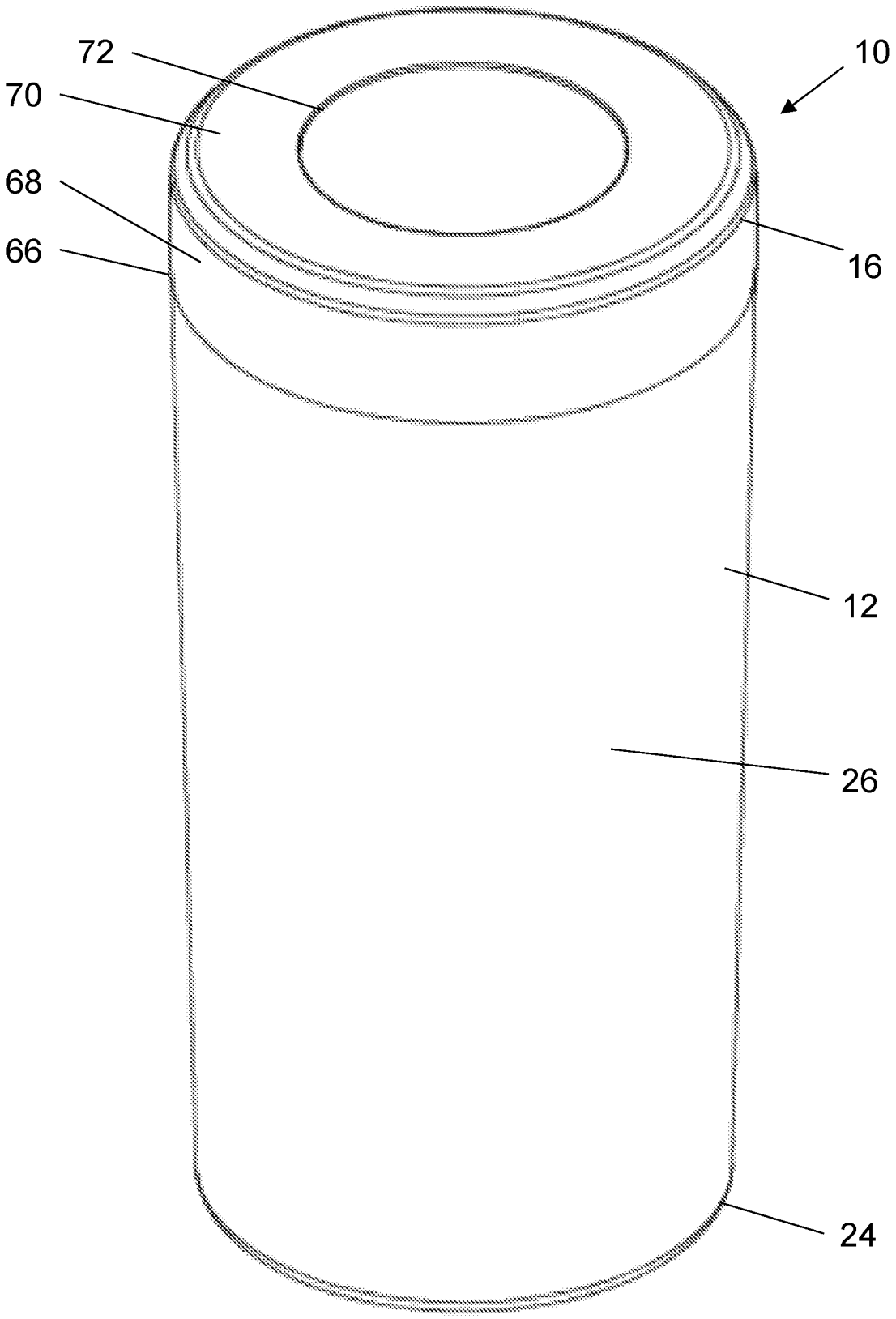
FIG. 1A is a side perspective view of an insulating beverage container.
Figure 1B:
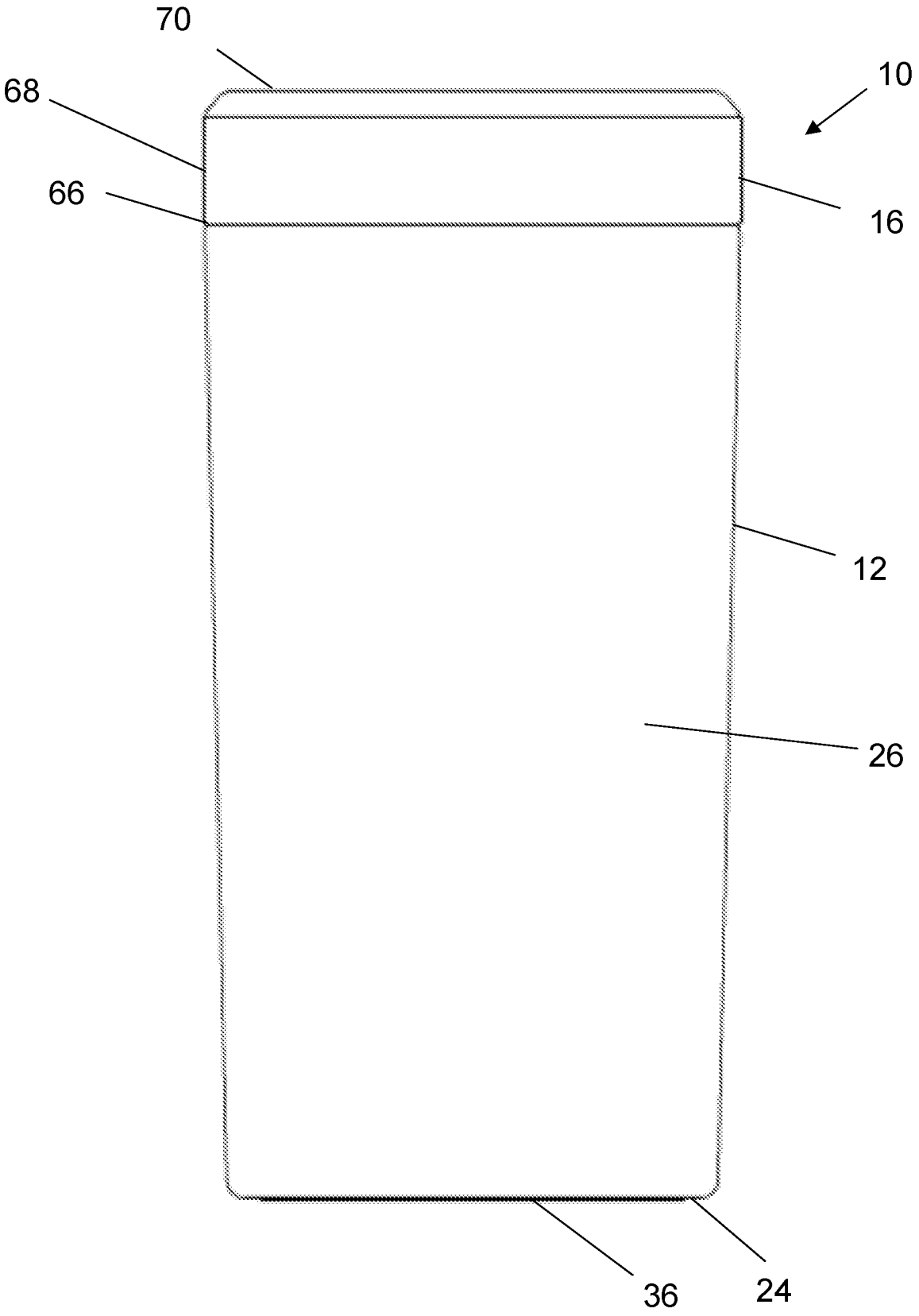
FIG. 1B is a side view of the insulating beverage container.
Figure 1C:
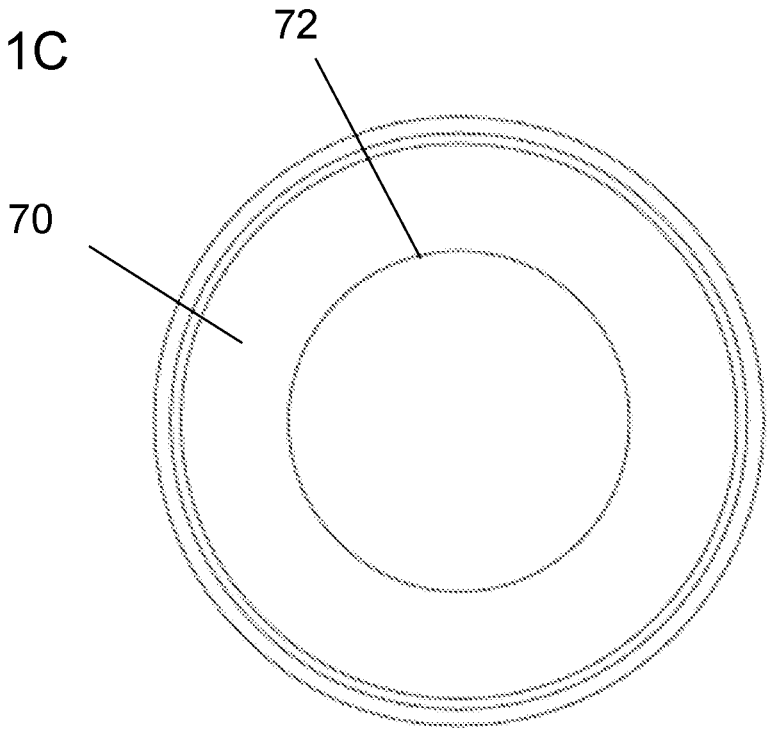
FIG. 1C is a top view of the insulating beverage container with the insert omitted.
Figure 1D:
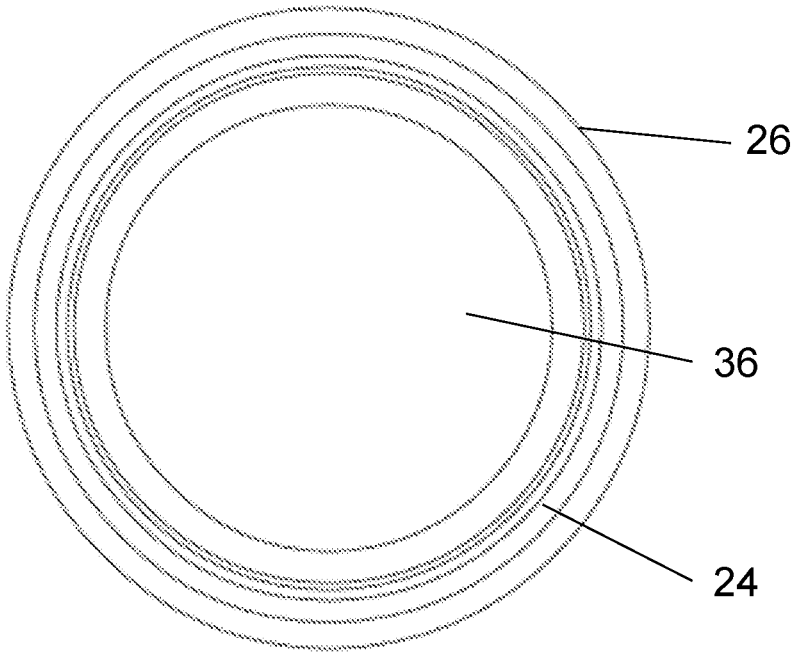
FIG. 1D is a bottom view of the insulating beverage container.
Figure 2A:
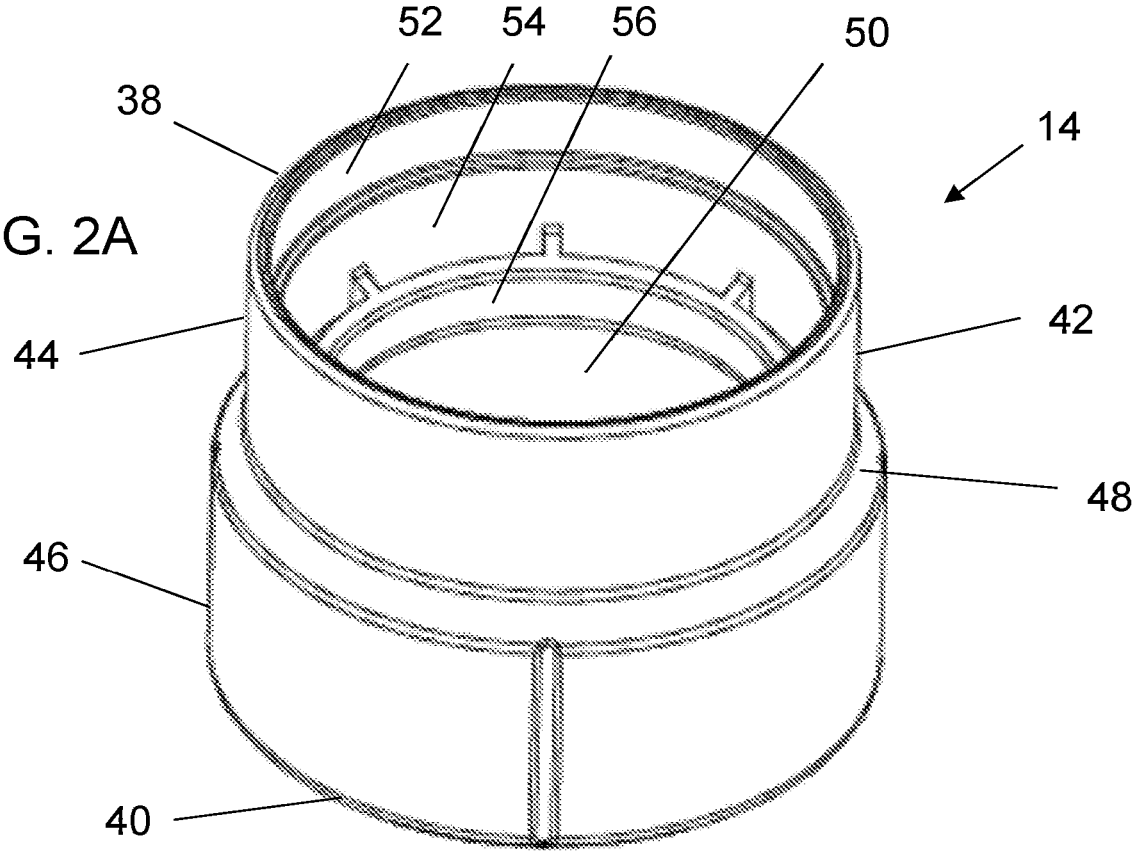
FIG. 2A is a side perspective view of an insert with the first end oriented upwards.
Figure 2B:
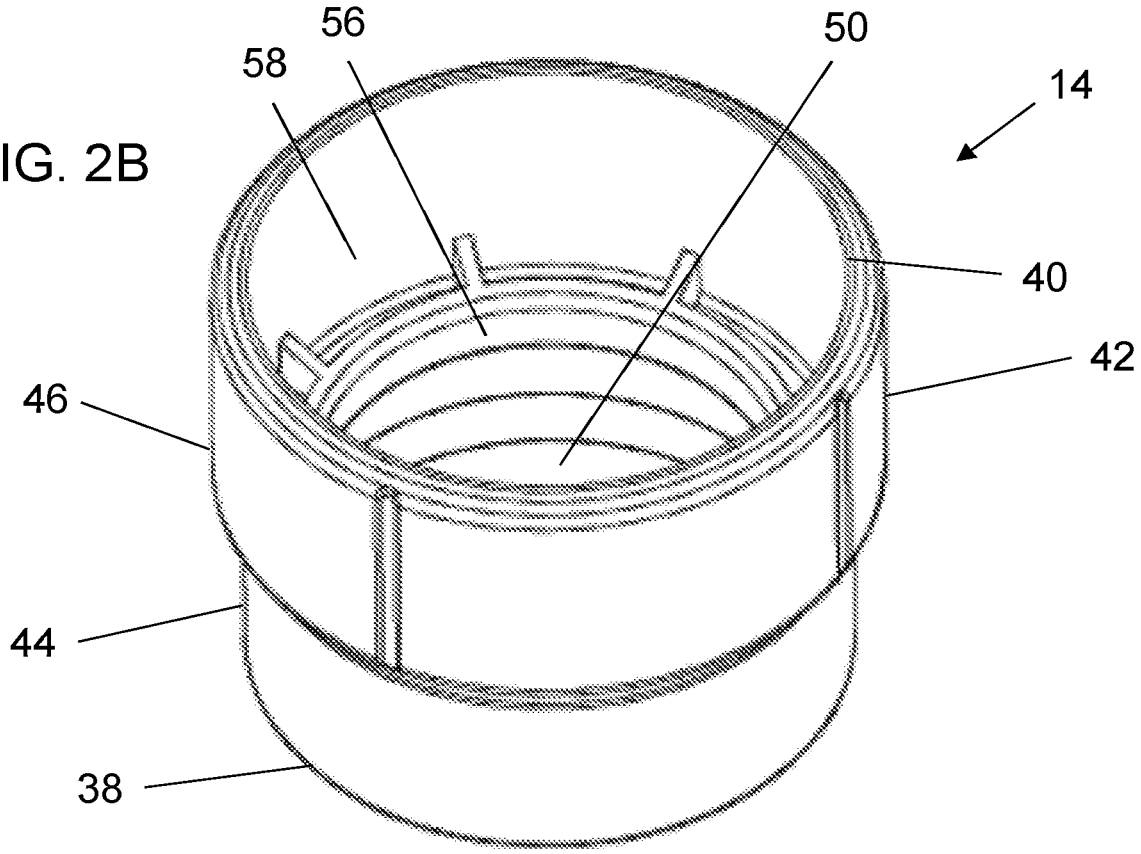
FIG. 2B is a is a side perspective view of the insert with the second end oriented upwards.
Figure 2C:
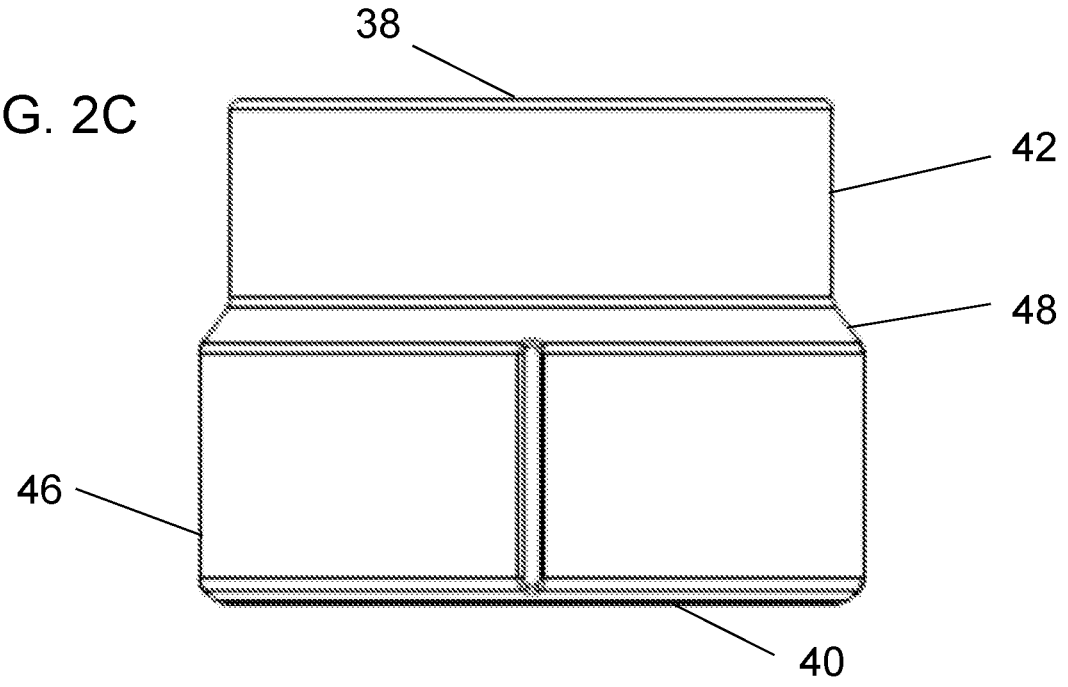
FIG. 2C is a side view of the insert with the first end oriented upwards.
Figure 2D:
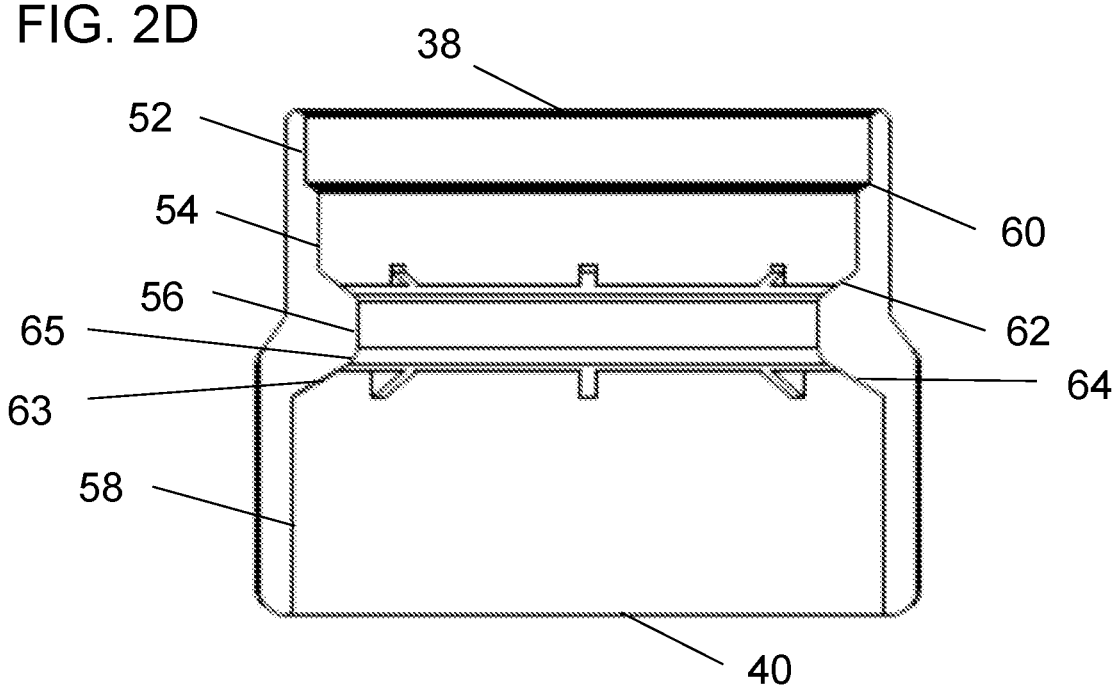
FIG. 2D is a side cross-sectional view of the insert with the first end oriented upwards.
Figure 2E:
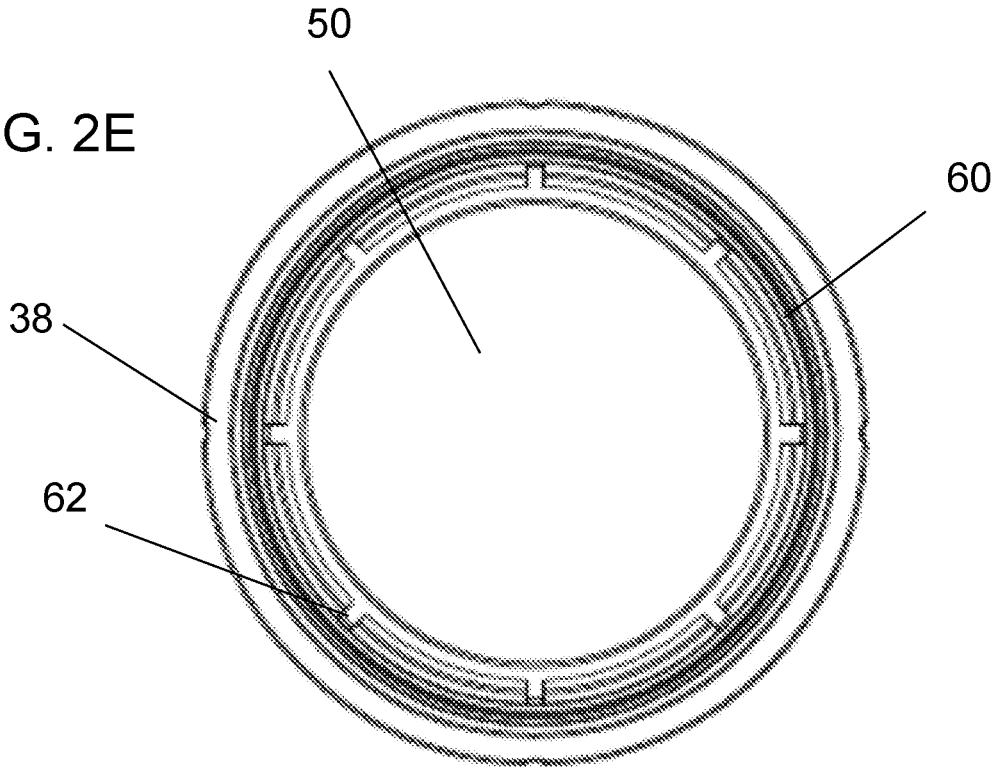
FIG. 2E is a first end view of the insert.
Figure 2F:
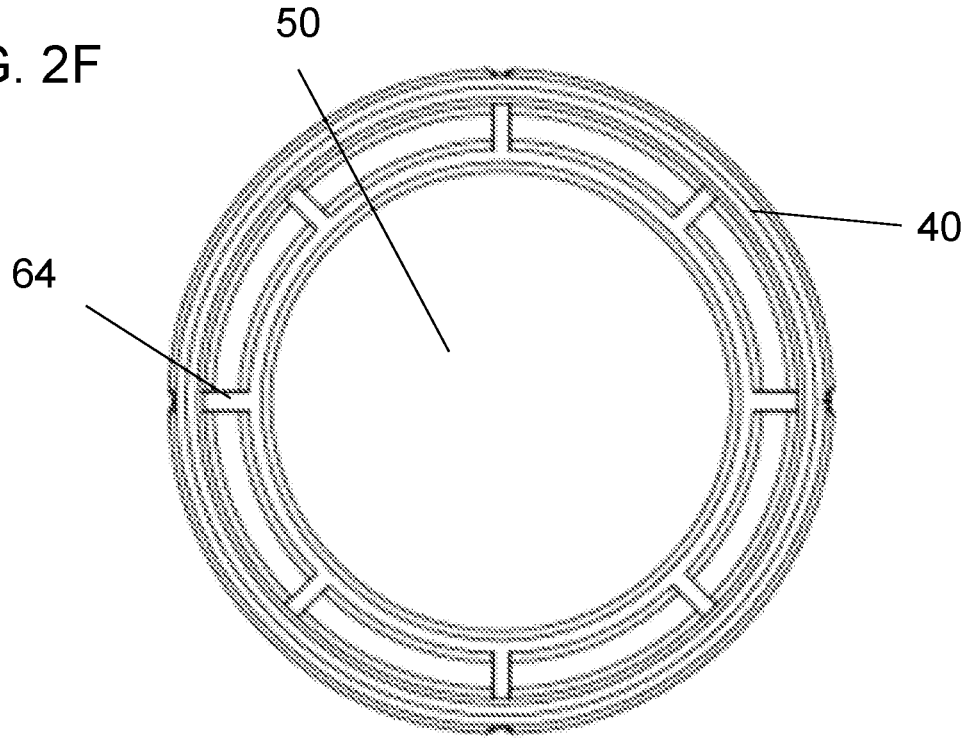
FIG. 2F is a second end view of the insert.
Figure 3:
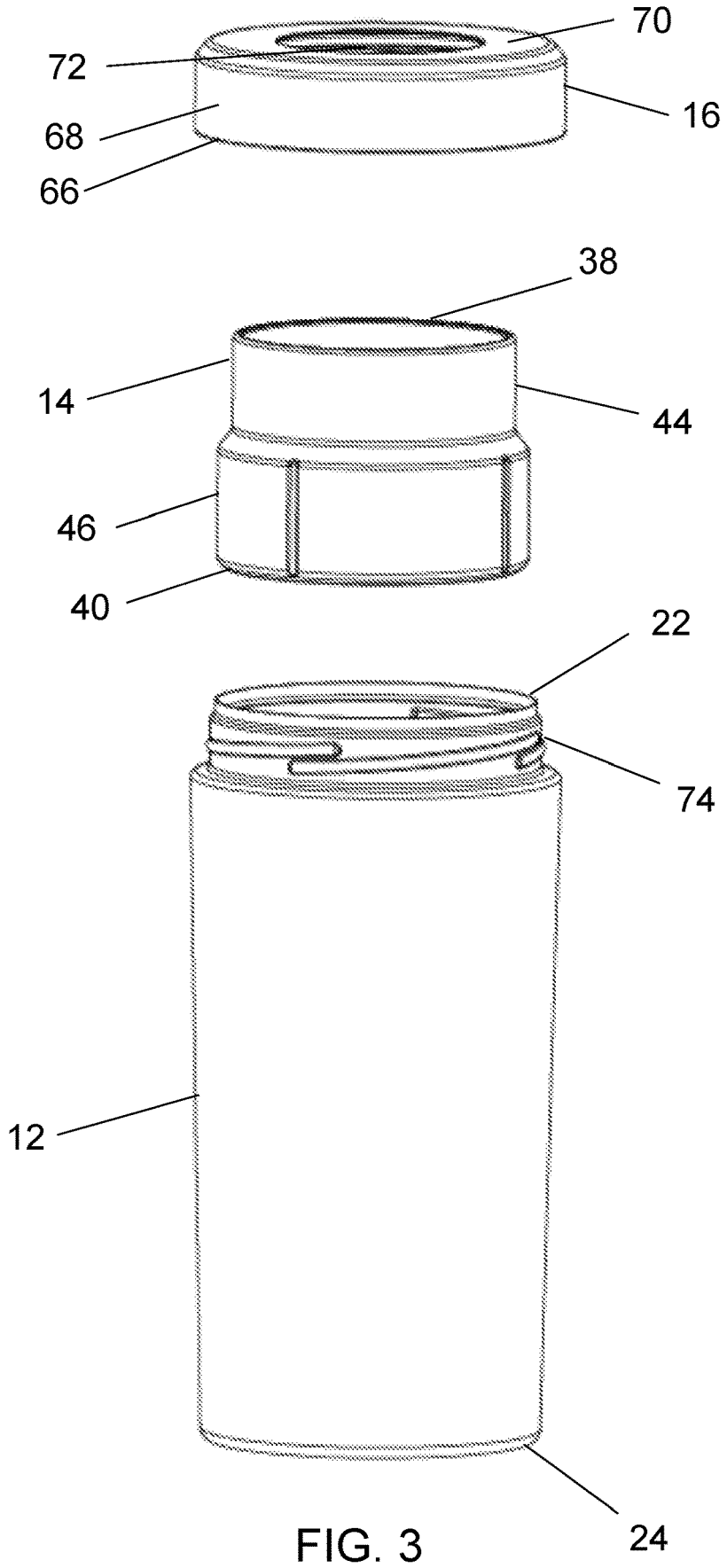
FIG. 3 is an exploded side view the container body, insert and cover.
Figure 4:
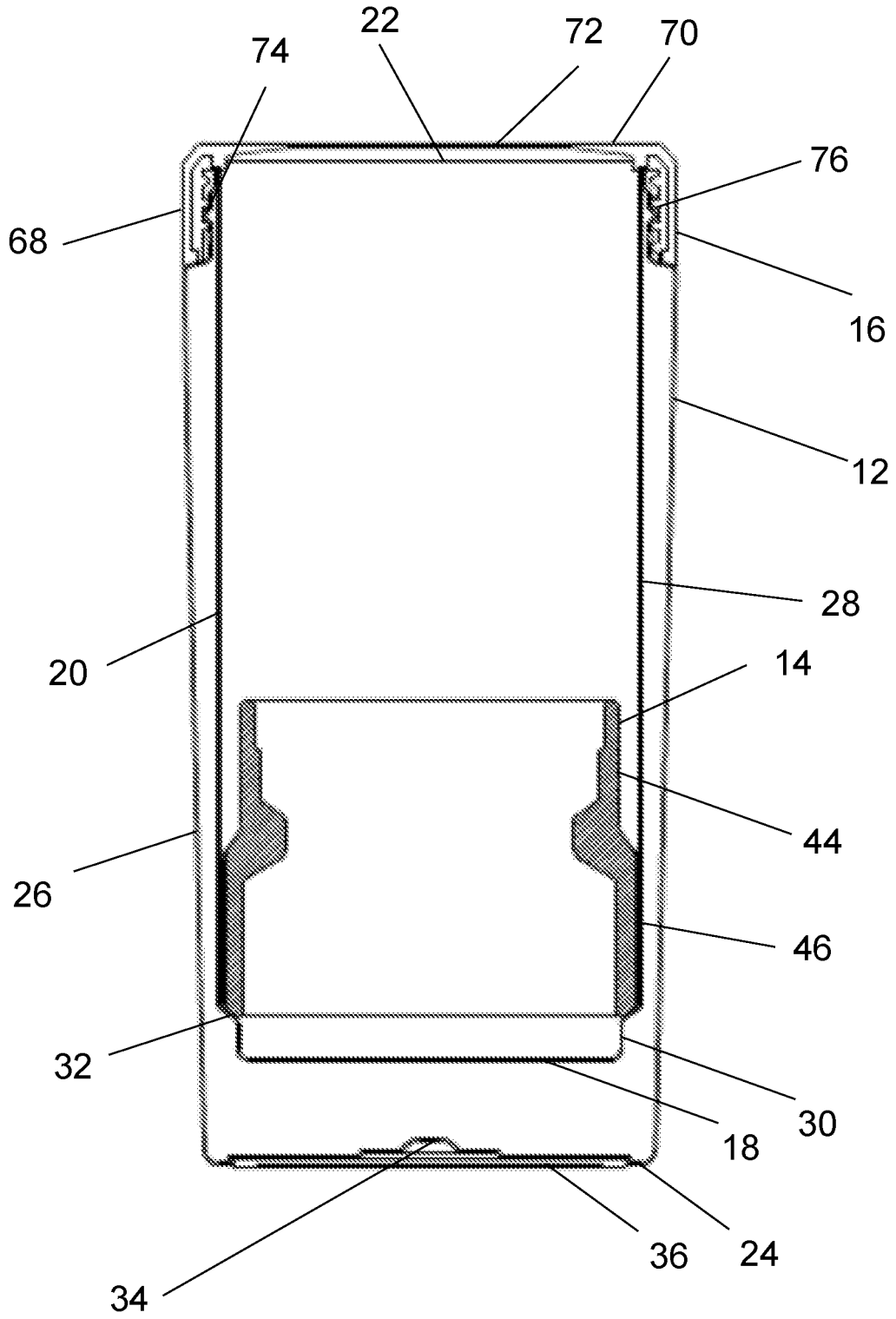
FIG. 4 is a side cross-sectional view of the container body, insert and cover, with the second end of the insert oriented toward the interior bottom.

For the purposes of promoting an understanding of the principles of the invention, reference will now be made to selected embodiments illustrated in the drawings and specific language will be used to describe the same. It will nevertheless be understood that no limitation of the scope of the invention is thereby intended; any alterations and further modifications of the described or illustrated embodiments, and any further applications of the principles of the invention as illustrated herein are contemplated as would normally occur to one skilled in the art to which the invention relates. At least one embodiment of the invention is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to "advantages" provided by some embodiments of the present invention, other embodiments may not include those same advantages, or may include different advantages. Any advantages described herein are not to be construed as limiting to any of the claims.

Specific quantities (spatial dimensions, dimensionless parameters, etc.) may be used explicitly or implicitly herein, such specific quantities are presented as examples only and are approximate values unless otherwise indicated. Any quantities referred to as "about" a given value are defined as being within 5% of the stated value unless otherwise specified (e.g., "about 1.0 mm" refers to the range of 0.95 mm to 1.05 mm; "between about 1.0 mm and 2.0 mm" refers to the range of 0.95 mm to 2.1 mm). Discussions pertaining to specific compositions of matter, if present, are presented as examples only and do not limit the applicability of other compositions of matter, especially other compositions of matter with similar properties, unless otherwise indicated. The terms top and bottom, upper and lower, and similar language used herein refer to the orientation of the insulating beverage container as shown in the drawings.

Referring to FIGS. 1A-D, 2A-F, 3 and 4, a first embodiment of an insulating beverage container 10 includes a container body 12, an insert 14, and a cover 16.

The container body 12 includes an interior bottom 18, an inner wall 20 extending peripherally around the interior bottom 18 and terminating in an open upper end 22, and an exterior bottom 24 spaced from the interior bottom 18, an outer wall 26 extending peripherally around the exterior bottom 24 and spaced from the inner wall 20 to define an insulating space 27 between the inner wall 20 and outer wall 26 and terminating at the open upper end 22. The inner wall 20 includes an upper portion 28 and a lower portion 30, wherein the upper portion 28 and the lower portion 30 each have a consistent diameter, the consistent diameter of the lower portion 30 being smaller than the consistent diameter of the upper portion 28. In an exemplary embodiment, the diameter of the lower portion 30 is about 68.80 mm and the diameter of the upper portion 28 is about 75.80 mm. The inner wall 20 includes an annular inner wall ledge 32 formed between the upper portion 28 of the inner wall 20 and lower portion 30 of the inner wall 20.

The exterior bottom 24 may include an elevated (as viewed from beneath) or concave surface 34. In the depicted embodiment, a resilient non-slip base 36 is positioned at least partially within the concave surface 34. In some embodiments, the resilient base 36 is a thin rubber disc.

The outer container 12 has a generally cylindrical shape, slightly tapering from the upper end 22 to the exterior bottom 24, and may be rotationally symmetrical. In other embodiments (not shown), the outer container 12 may not be symmetrical and may include a handle or other feature for grasping the outer container 12.

The insert 14 includes a circular open first end 38, a circular open second end 40, and a side 42 extending between the first end 38 and second end 40. The side includes a first portion 44 adjacent the first end and a second portion 46 adjacent the second end 40, and an annular side ledge 48 formed between the first portion 44 and the second portion 46.

Figure 8:
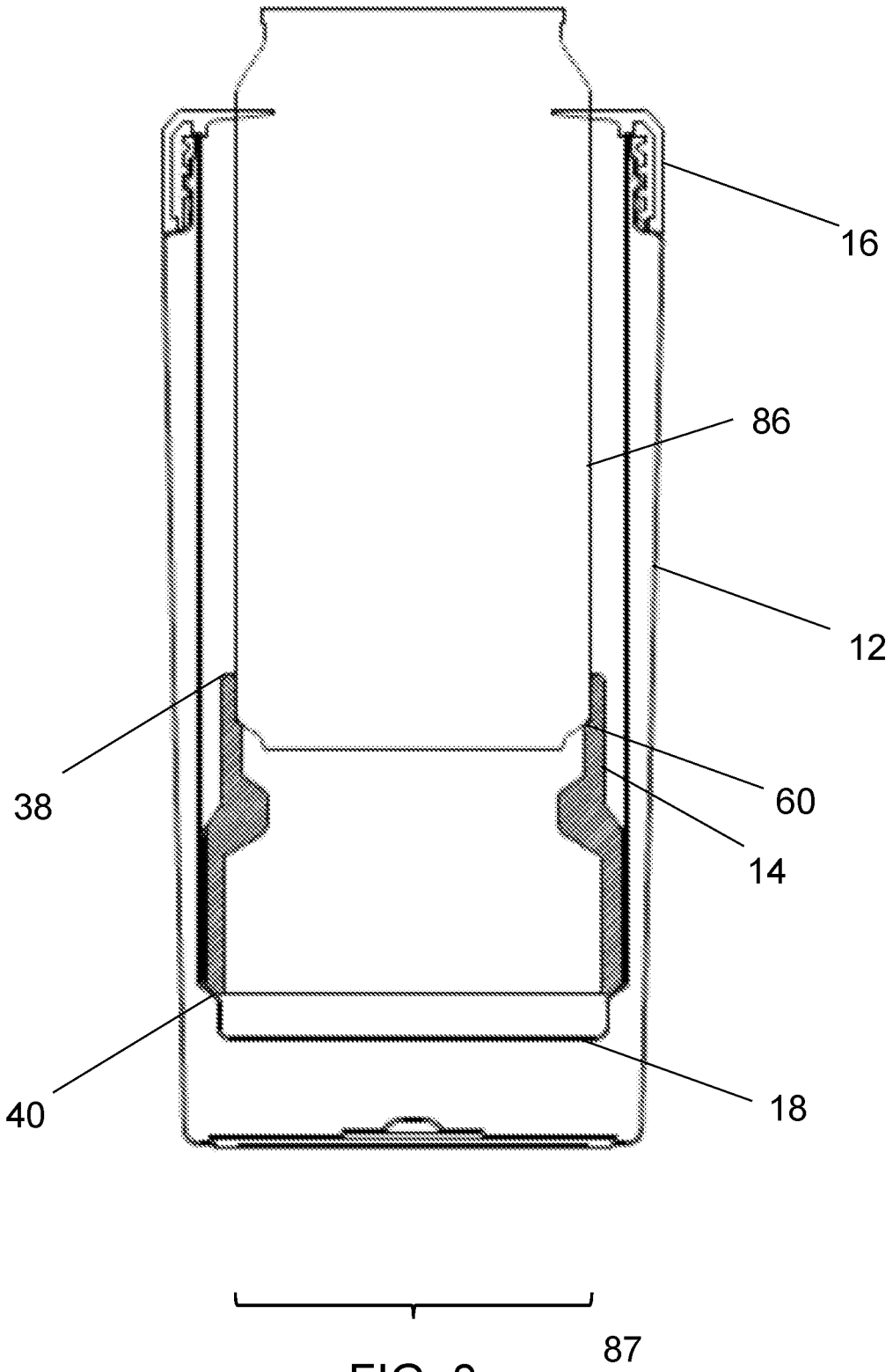
FIG. 8 is a side cross-sectional view of the insulating beverage container holding an alternate configuration 12 oz. beverage can, with the second end of the insert toward the interior bottom.
Figure 9:
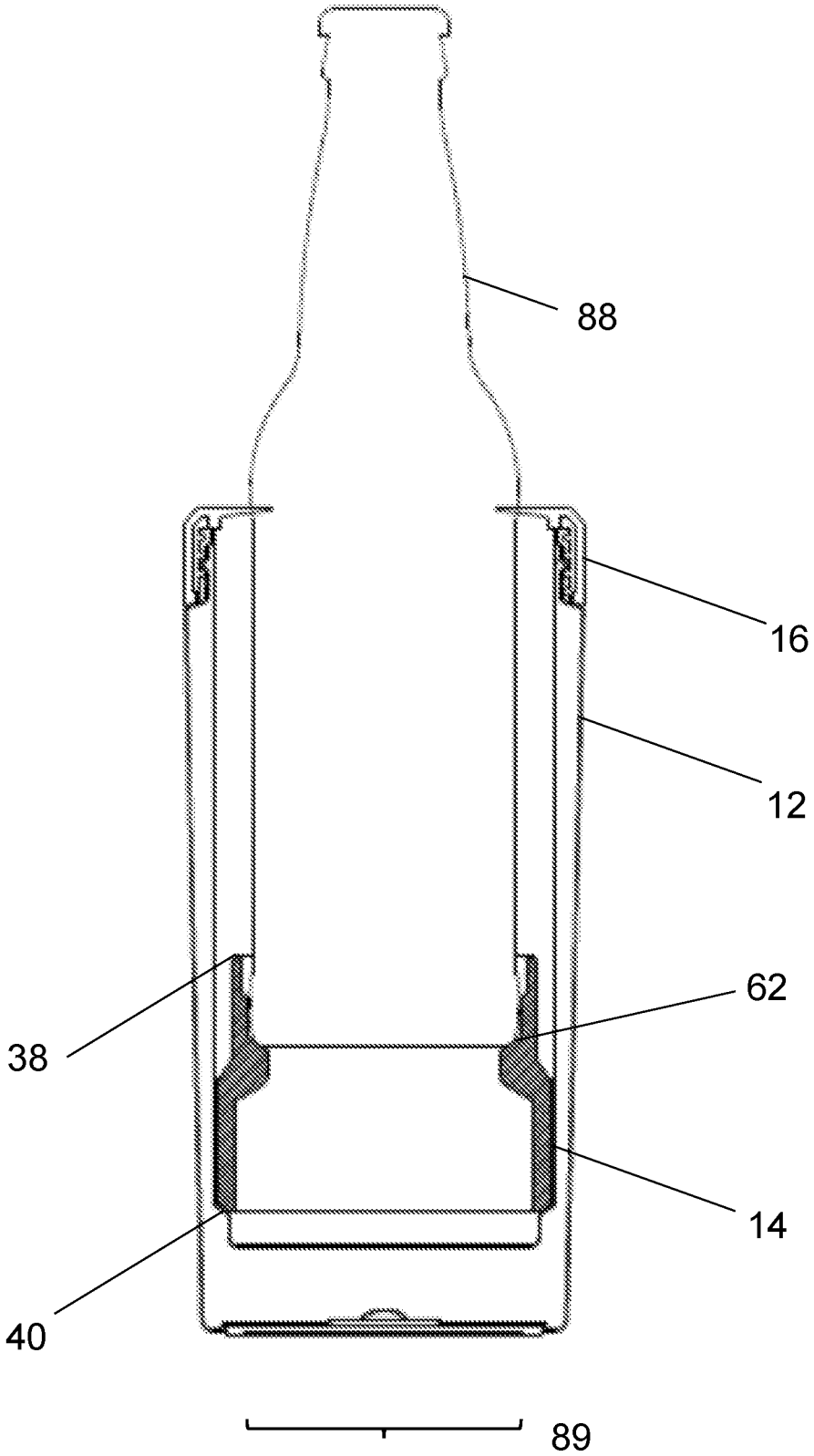
FIG. 9 is a side cross-sectional view of the insulating beverage container holding a 12 oz. beverage bottle, with the second end of the insert toward the interior bottom.
Figure 10:
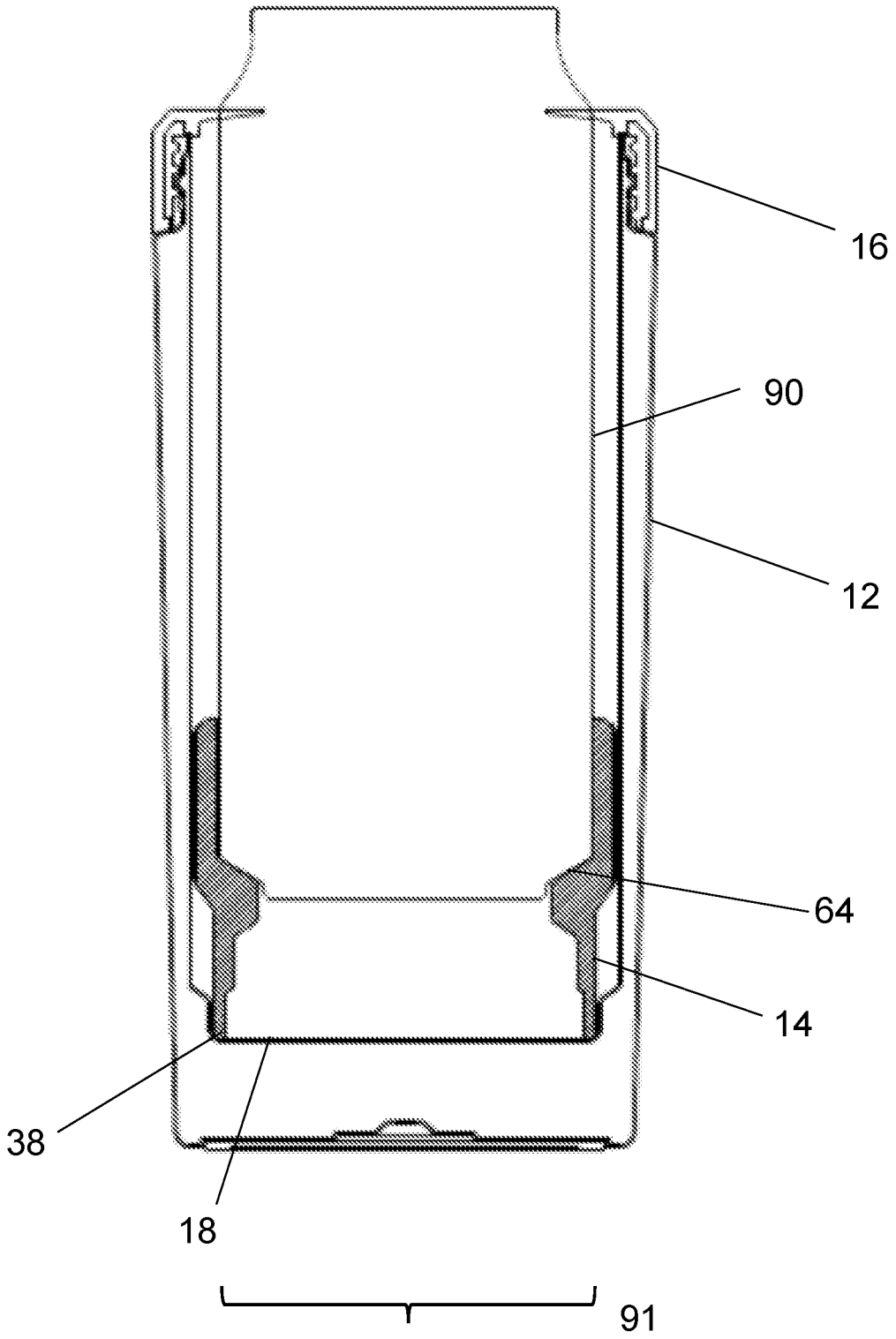
FIG. 10 is a side cross-sectional view of the insulating beverage container holding a 16 oz. tallboy beverage can, with the first end of the insert toward the interior bottom.
Figure 11:
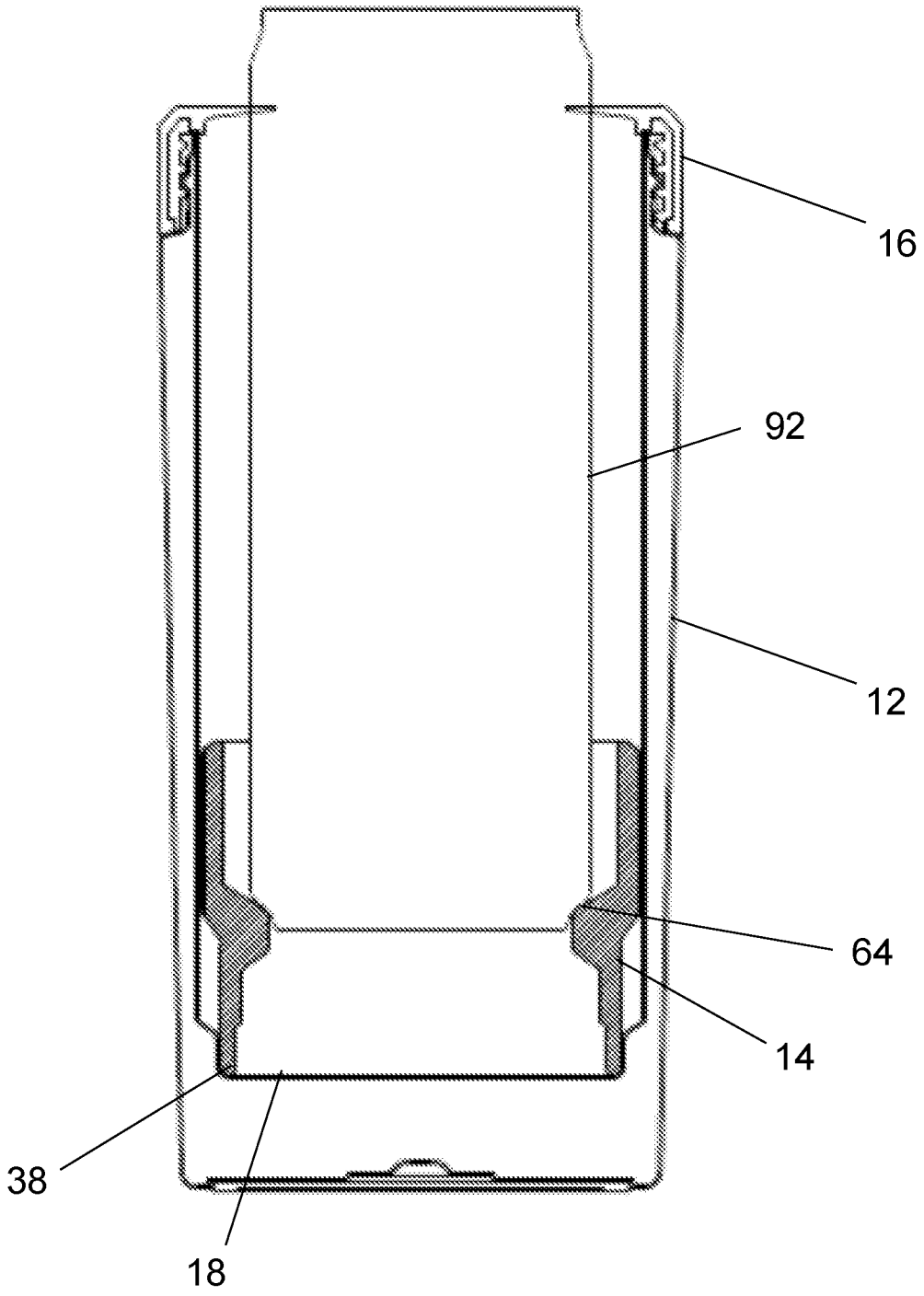
FIG. 11 is a side cross-sectional view of the insulating beverage container holding a 12 oz. slim beverage can, with the first end of the insert toward the interior bottom.

The insert 14 is configured to removably fit within the container body 12 through the open upper end 22. The first portion 44 is sized to snugly fit within the lower portion 30 of the container body 12 and the second portion 46 is sized to snugly fit within the upper portion 28 of the container body 12, such that the diameter of the first portion 44 of the insert 14 is smaller than the diameter of the second portion 46 of the insert 14. In an exemplary embodiment, the diameter of the first portion is about 68.00 mm, the diameter of the second portion is about 74.94 mm, and the height of the insert is about 57.00 mm. In use, the insert 14 may be inserted into the container body 12 with the first end 38 oriented upwards toward the open upper end 22, and the second end 40 resting atop the inner wall ledge 32, as shown in FIGS. 4, 7, 8 and 9. The insert 14 may alternatively be inserted into the container body 12 with the second end 40 oriented upwards toward the open upper end 22, and the first end 38 fitting within the lower portion 30 and resting atop the interior bottom 18, as shown in FIGS. 10 and 11.

The insert 14 includes an internal bore 50 extending between the first end 38 and the second end 40. Passage of air through the bore 50 prevents the formation of a vacuum between the insert 14 and container body 12, facilitating the insertion and removal of the insert 14 from the container body 12. The internal bore 50 includes a plurality of different interior diameters. As most easily seen in FIG. 2D, the internal bore 50 includes a first segment adjacent 52 the first end 38, a second segment 54 adjacent the first segment 52, a third segment 56 adjacent the second segment 54, and a fourth segment 58 adjacent the third segment 56 and adjacent the second end 40. Each of the segments 52, 54, 56, 58 has a different diameter. In an exemplary embodiment, the interior diameter of the first segment 52 is about 63.4 mm, the interior diameter of the second segment 54 is about 61.0 mm, the interior diameter of the third segment 56 is about 52.0 mm, and the interior diameter of the fourth segment 58 is about 67.0 mm. A first ledge 60 is formed between first segment 52 and second segment 54. In exemplary embodiment, the first ledge 60 is at an angle of about 120°. A second ledge 62 is formed between the second segment 54 and third segment 56. In exemplary embodiment, the second ledge 62 is at an angle of about 124°. A third ledge 64 is formed between the third segment 56 and fourth segment 58. In an exemplary embodiment, the third ledge 64 includes a first ledge portion 63 adjacent the fourth segment at an angle of about 120° and a second ledge portion 65 adjacent the third segment at an angle of about 150°. Many beverage bottles and cans possess heels, that is, angled or curved lower parts of bottles and cans where the sidewall turns from vertical to the horizontal. The angles of the first ledge 60, second ledge 62, and first ledge portion 63 and second ledge portion 65 of the third ledge 64 are selected to mate with the heels of the various beverage bottles and cans.

The cover includes a circular base 66 and a cylindrical sidewall 68 extending generally upwards from the circular base 66 to a top surface 70. The top surface 70 includes an aperture 72 having a diameter smaller than the first portion 44 of the insert 14 to mechanically retain the insert 14 within the container body 12, while allowing the top of a beverage bottle or beverage can to extend through the aperture 72, as shown in FIGS. 5-11. A user may then drink from the beverage bottle or beverage can while the majority of the bottle or can remains insulated within the insulating beverage container 10.

The cover 16 is configured to removably attach and detach from the container body 12 via threading, snap fit, interference fit, or other type of engagement as generally known in the art. In the depicted embodiment, the outer wall 26 includes threading 74 adjacent the upper end 22 and the sidewall 68 of the cover 16 includes an interior surface 76 with corresponding threading configured to engage the threading 74 on the outer wall 26. When in an assembled configuration, as most easily seen in FIG. 4, the cover 16 fits over and around the upper end 22 of the container body 12 to enclose the insert 14.

Figure 5:
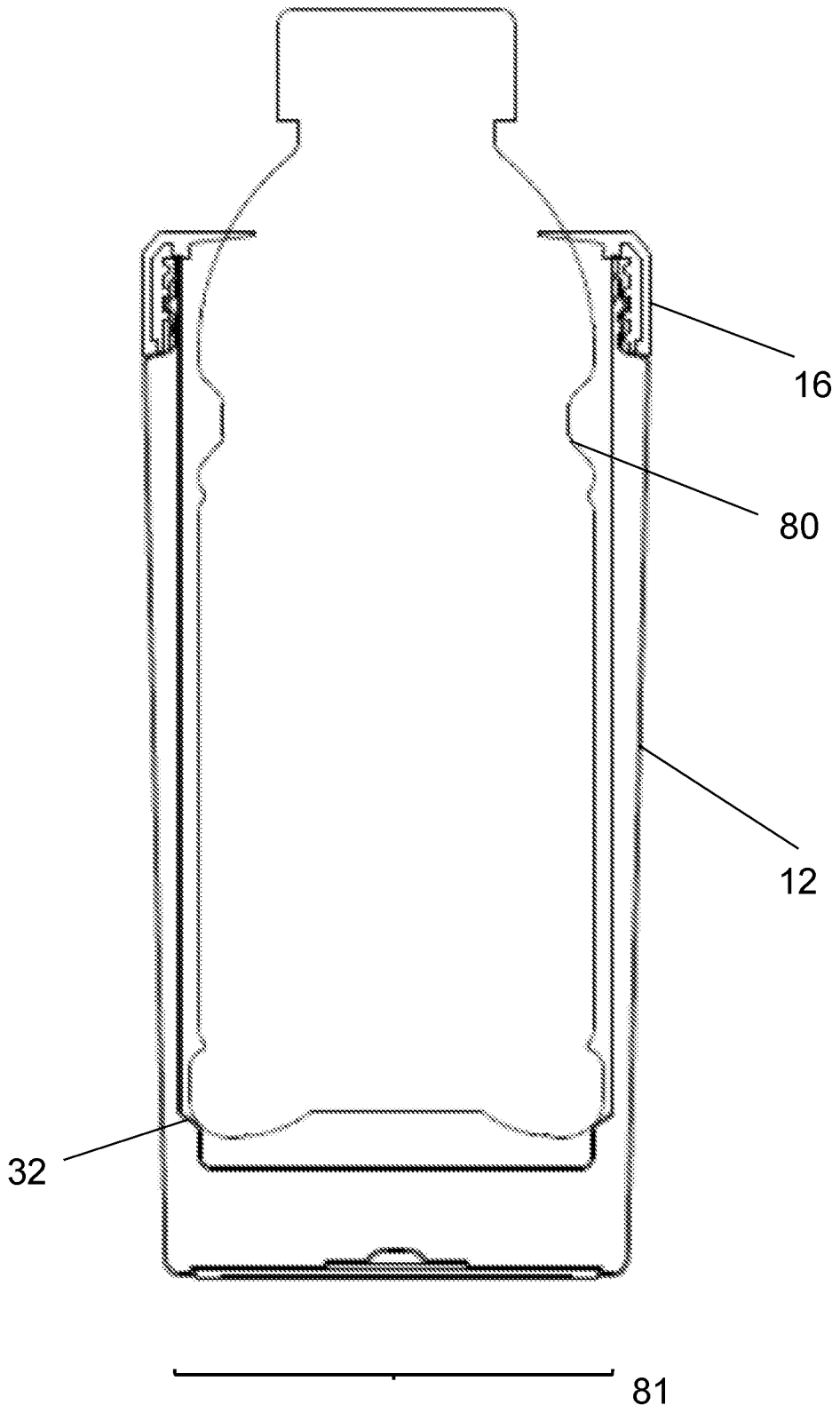
FIG. 5 is a side cross-sectional view of the insulating beverage container holding a 20 oz. sports bottle with the insert removed.
Figure 6:
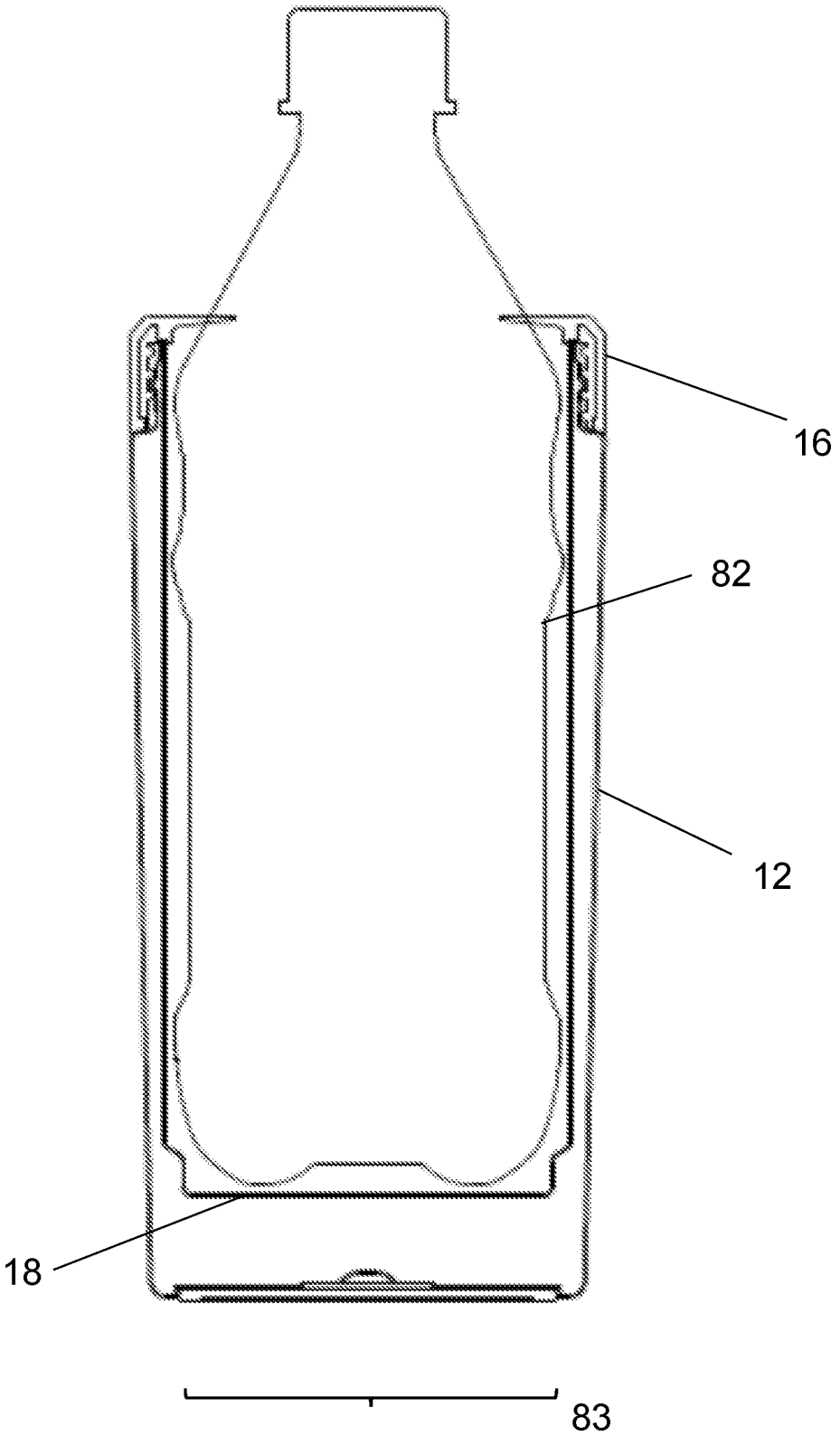
FIG. 6 is a side cross-sectional view of the insulating beverage container holding a 20 oz. beverage bottle with the insert removed.
Figure 7:
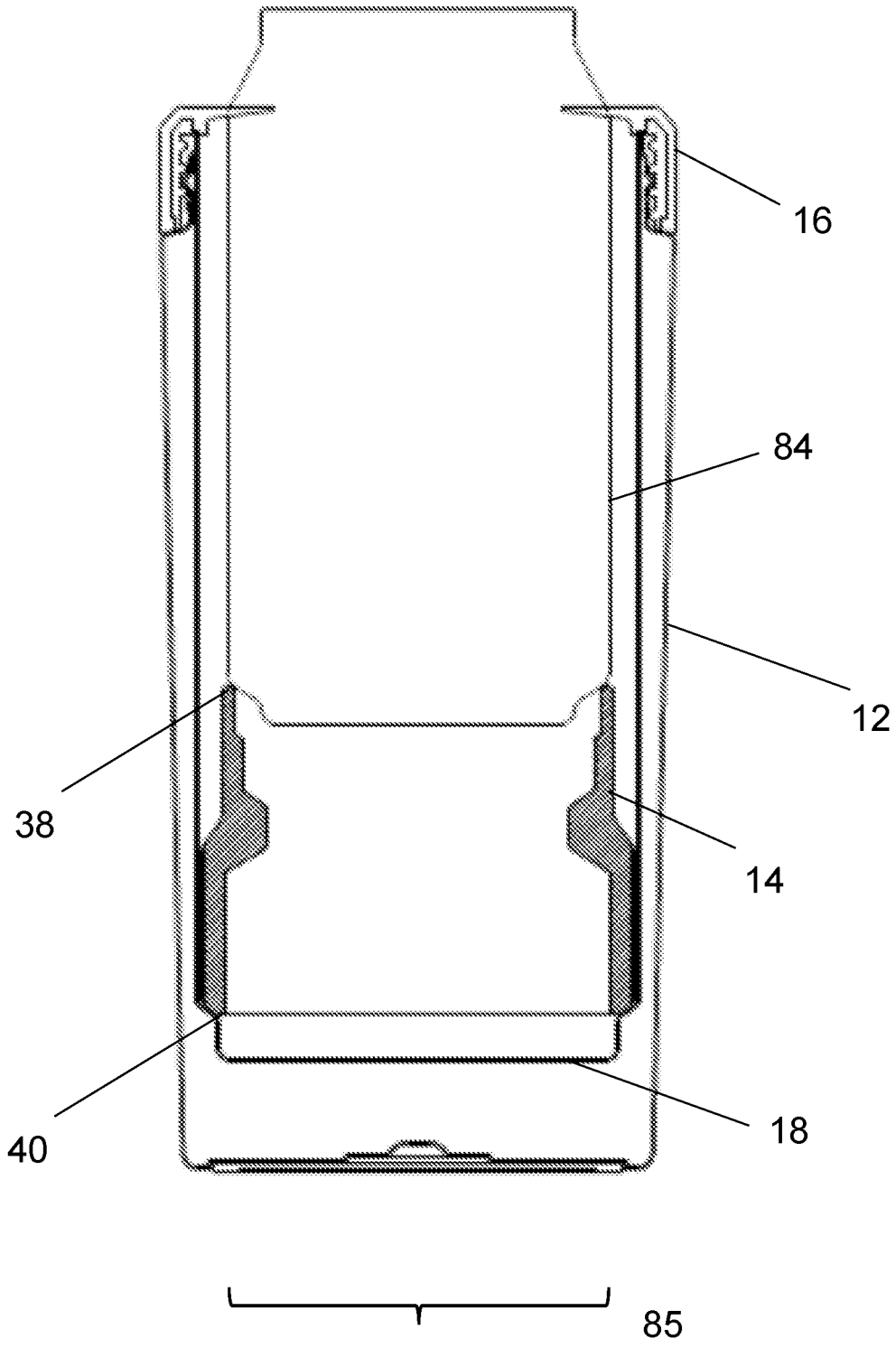
FIG. 7 is a side cross-sectional view of the insulating beverage container holding a 12 oz. beverage can, with the second end of the insert toward the interior bottom.

The insulating beverage container 10 is configured to accommodate and securely retain beverage cans or beverage bottles of at least seven different combinations of diameters and heights (collectively referred to as the "configurations" of the bottle or can): (1) a first configuration as shown in FIG. 5, wherein the insert is not present and the heel of the 20 oz. sports bottle 80 is supported by the annular inner wall ledge 32 having a first diameter 81 of about 75.8 mm (i.e., the diameter of the upper portion 28 of the inner wall 20); (2) a second configuration as shown in FIG. 6, wherein the insert is not present and the bottom of the 20 oz. beverage bottle 82 is supported by the interior bottom 18 having a second diameter 83 of about 68.80 mm (i.e., the diameter of the lower portion 30 of the inner wall 20); (3) a third configuration as shown in FIG. 7, wherein the second end 40 of the insert 14 is oriented toward the interior bottom 18 and the heel of the 12 oz. can 84, having a diameter of about 65.80 mm, is supported by the first end of the insert 14 having a third diameter 85 of about 68.00 mm; (4) a fourth configuration as shown in FIG. 8, wherein the second end 40 of the insert 14 is oriented toward the interior bottom 18 and the heel of the alternate configuration 12 oz. can 86, having a diameter of about 63.02 mm, is supported by the first ledge 60 having a fourth diameter 87 of about 63.40 mm (i.e., the diameter of the first segment 52); (5) a fifth configuration as shown in FIG. 9, wherein the second end 40 of the insert 14 is oriented toward the interior bottom 18 and the bottom of the 12 oz. bottle 88, having a diameter of about 60.5 mm, is supported by the second ledge 62 having a fifth diameter 89 of about 61.00 mm (i.e., the diameter of the second segment 54); (6) a sixth configuration as shown in FIG. 10, wherein the first end 38 of the insert 14 is oriented toward the interior bottom 18 and the heel of the 16 oz. tallboy can 90, having a diameter of about 65.75 mm, is supported by first ledge portion 63 the third ledge 64 having a sixth diameter 91 of about 67.00 mm (i.e., the diameter of the fourth segment 58); and (7) a seventh configuration as shown in FIG. 11, wherein the first end 38 of the insert 14 is oriented toward the interior bottom 18 and the heel of the slim 12 oz. can 92, having a diameter of about 57.49 mm, is supported by the second ledge portion 65 of the third ledge 64. As indicated in FIGS. 10 and 11, the heel of the beverage bottle or beverage can need not contact the entirety of the third ledge 64 to be supported thereby.

With the variety of interior diameters and heights provided by the interior bottom 18, inner wall ledge 32, and ends 38, 40 of the insert 14 and various ledges 60, 62, 63 within the internal bore 50 of the insert 14, the present invention is configured to partially enclose and insulating beverage cans or bottles of a variety of diameters and heights. Using the dimensions of the exemplary embodiment, the insulating beverage container 10 is capable of accepting beverage cans or bottles with diameters less than about 75.8 mm and greater than about 52.0 mm, which constitutes the vast majority of beverage cans and bottles in commercial use in the United States.

Various aspects of different embodiments of the present disclosure are expressed in paragraph X1 as follows:

X1. One embodiment of the present disclosure includes an insulating beverage container comprising a container body having an interior bottom, an inner wall extending peripherally around the interior bottom and terminating in an open upper end, an exterior bottom spaced from the interior bottom, and an outer wall extending peripherally around the exterior bottom and spaced from the inner wall to define an insulating space between the inner wall and outer wall and terminating at the open upper end, wherein the inner wall includes an upper portion and a lower portion, wherein the lower portion of the inner wall has a smaller diameter than the upper portion of the inner wall, and wherein the inner wall includes an annular inner wall ledge formed between the upper portion of the inner wall and lower portion of the inner wall; a cover removably attached to the open upper end; and an insert removably nested within the container body through the open upper end, the insert having a circular open first end, a circular open second end, a side extending between the first end and the second end, and an internal bore extending between the first end and the second end, wherein the internal bore has a plurality of different interior diameters, wherein the side of the insert includes a first portion adjacent the first end and a second portion adjacent the second end, wherein the first portion of the side has a smaller diameter than the second portion of the side, and wherein the side includes an annular side ledge formed between the first portion of the side and the second portion of the side.

Yet other embodiments include the features described in paragraph X1, as combined with one of more of the following aspects:

Wherein the first portion of the insert has a diameter sized to snugly fit within the lower portion of the inner wall, and wherein the second portion of the insert has a diameter sized to snugly fit within the upper portion of the inner wall.

Wherein the diameter of the lower portion is about 68.80 mm and the diameter of the upper portion is about 75.80 mm.

Wherein the cover fits over and around the upper end of the container body to enclose the insert.

Wherein the cover includes a circular base and cylindrical sidewall extending generally upwards from the circular base to a top surface.

Wherein the top surface includes an aperture having a diameter smaller than the diameter of the first portion of the insert.

Wherein the aperture is sized to pass at least a portion of a beverage can or beverage bottle.

Wherein the internal bore of the insert includes a first segment adjacent the first end, a second segment adjacent the first segment, a third segment adjacent the second segment and a fourth segment adjacent the third segment and adjacent the second end; and wherein each of the first segment, second segment, third segment and fourth segment have different interior diameters.

Wherein the interior diameter of the first segment is about 63.4 mm, the interior diameter of the second segment is about 61.0 mm, the interior diameter of the third segment is about 52.0 mm, and the interior diameter of the fourth segment is about 67.0 mm.

Wherein the insulting beverage container includes a first ledge formed between first segment and second segment, a second ledge formed between the second segment and third segment, and a third ledge formed between the third segment and fourth segment.

Wherein the first ledge is set at an angle of about 120° and the second ledge 62 is set at an angle of about 124°.

Wherein the third ledge includes a first ledge portion adjacent the fourth segment and a second ledge portion adjacent the third segment.

Wherein the first ledge portion is set at an angle of about 120° and the second ledge portion is set at an angle of about 150°.

The foregoing detailed description is given primarily for clearness of understanding and no unnecessary limitations are to be understood therefrom, for modifications can be made by those skilled in the art upon reading this disclosure and may be made without departing from the spirit of the invention. Although specific spatial dimensions are stated herein, such specific quantities are presented as examples only. Reference systems, if used herein, refer generally to various directions (for example, top, bottom, upper, lower, forward, rearward, left, right, etc.), which are merely offered to assist the reader in understanding the various embodiments of the disclosure and are not to be interpreted as limiting. Other reference systems may be used to describe various embodiments.

What is claimed is:

1. An insulating beverage container comprising:

a container body having an interior bottom, an inner wall extending peripherally around the interior bottom and terminating in an open upper end, an exterior bottom spaced from the interior bottom, and an outer wall extending peripherally around the exterior bottom and spaced from the inner wall to define an insulating space between the inner wall and outer wall and terminating at the open upper end, wherein the inner wall includes an upper portion and a lower portion, wherein the lower portion of the inner wall has a smaller diameter than the upper portion of the inner wall, and wherein the inner wall includes an annular inner wall ledge formed between the upper portion of the inner wall and lower portion of the inner wall;

a cover removably attached to the open upper end; and an insert having a circular open first end, a circular open second end, a side extending between the first end and the second end, and an internal bore extending between the first end and the second end, wherein the internal bore has a plurality of different interior diameters, wherein the side of the insert includes a first portion adjacent the first end and a second portion adjacent the second end, wherein the first portion of the side has a smaller diameter than the second portion of the side, and wherein the side includes an annular side ledge formed between the first portion of the side and the second portion of the side, wherein the insert removably nests within the container body through the open upper end in a first orientation with the second end oriented toward the open upper end of the container body and with the first end resting atop the interior bottom of the container body, and wherein the insert removably nests within the container body through the upper end in a second orientation with the first end oriented toward the open upper end of the container body and with the second end resting atop the annular inner wall ledge of the container body.

2. The insulating beverage container of claim 1, wherein the first portion of the insert has a diameter sized to snugly fit within the lower portion of the inner wall, and wherein the second portion of the insert has a diameter sized to snugly fit within the upper portion of the inner wall.

3. The insulating beverage container of claim 1, wherein the cover fits over and around the upper end of the container body to enclose the insert.

4. The insulating beverage container of claim 1, wherein the cover includes a circular base and cylindrical sidewall extending generally upwards from the circular base to a top surface.

5. The insulating beverage container of claim 4, wherein the top surface includes an aperture having a diameter smaller than the diameter of the first portion of the insert.

6. The insulating beverage container of claim 5, wherein the aperture is sized to pass at least a portion of a beverage can or beverage bottle.

7. The insulating beverage container of claim 1, wherein the internal bore of the insert includes a first segment adjacent the first end, a second segment adjacent the first segment, a third segment adjacent the second segment and a fourth segment adjacent the third segment and adjacent the second end; and wherein each of the first segment, second segment, third segment and fourth segment have different interior diameters.

8. The insulating beverage container of claim 7, further comprising a first ledge formed between first segment and second segment, a second ledge formed between the second segment and third segment, and a third ledge formed between the third segment and fourth segment.

9. The insulating beverage container of claim 8, wherein the first ledge is at an angle of about 120°.

10. The insulating beverage container of claim 8, wherein the second ledge is at an angle of about 124°.

11. The insulating beverage container of claim 10, wherein the first ledge portion is at an angle of about 120° and the second ledge portion is at an angle of about 150°.

12. The insulating beverage container of claim 8, wherein the third ledge includes a first ledge portion adjacent the fourth segment and a second ledge portion adjacent the third segment.

* * * * *